United States Patent [19]

Anahara et al.

[11] Patent Number: 4,569,193

[45] Date of Patent: Feb. 11, 1986

[54] APPARATUS FOR PRODUCING A FASCIATED YARN

[75] Inventors: Meiji Anahara, Kariya; Hiroshi Omori, Aichi; Kazuo Seiki, Kariya, all of Japan

[73] Assignee: Kabushiki Kaisha Toyoda Jidoshokki Seisakusho, Aichi, Japan

[21] Appl. No.: 740,006

[22] Filed: May 31, 1985

[30] Foreign Application Priority Data

Jun. 4, 1984 [JP] Japan ..... 59-114040
Jan. 14, 1985 [JP] Japan ..... 60-004699

[51] Int. Cl.[4] ..... D01H 5/28; D01H 1/13; D01H 7/92

[52] U.S. Cl. ..... 57/328; 57/333; 57/350

[58] Field of Search ..... 57/328, 327, 333, 350, 57/351, 5, 6; 28/271–276

[56] References Cited

U.S. PATENT DOCUMENTS 4,112,658 9/1978 Morihashi ..... 57/333 X
4,124,972 11/1978 Arai et al. ..... 57/328
4,142,354 3/1979 Nakahara ..... 57/328
4,183,202 1/1980 Morihashi ..... 57/328
4,399,648 8/1983 Kato ..... 57/328 X
4,434,611 3/1984 Hasegawa et al. ..... 57/333 X
4,437,302 3/1984 Anahara et al. ..... 57/333
4,489,545 12/1984 Susumu et al. ..... 57/333
4,497,167 2/1985 Nakahara et al. ..... 57/328
4,503,662 3/1985 Horiuchi et al. ..... 57/328 X

FOREIGN PATENT DOCUMENTS 52-63439 5/1977 Japan ..... 57/333

*Primary Examiner*—John Petrakes
*Attorney, Agent, or Firm*—Burgess, Ryan & Wayne

[57] ABSTRACT

An apparatus for producing a fasciated yarn comprising two air nozzles (2, 3) arranged at an angle in such a manner that a wedge shaped space (S) is formed therebetween, in which each of the air nozzles (2, 3) has a function of rotating a fiber bundle about the axis thereof in a direction that is the reverse of the other. A yarn passage from the first air nozzle (2) and to the second air nozzle (3) is so adapted that the fiber bundle is not in positive contact with an inner wall of an exit portion (7) of the first air nozzle (2) but is in contact with an inner wall of an inlet portion (4) of the second air nozzle (3), whereby a twist ascent from the second air nozzle (3) into the first air nozzle (2) is adequately suppressed and effective fasciated yarn forming is attainable. According to the wedge shaped space (S), the interference by exhaust air from the first air nozzle (2) with the second air nozzle (3) is eliminated.

10 Claims, 22 Drawing Figures

APPARATUS FOR PRODUCING A FASCIATED YARN

BACKGROUND OF THE INVENTION

1. Field of the Invention

The present invention relates to an apparatus for producing a fasciated yarn. More particularly, it relates to an apparatus of this type comprising two air nozzles, each of which impart a reverse directional twist to a fiber bundle.

2. Description of the Related Art

In a faciated yarn spinning system, a fiber bundle continuously fed from a feed roller of a drafting means is introduced into an air nozzle, in which it is twisted and then detwisted by a vortex whirling therein to form a fasciated yarn. To obtain a strong yarn, it is important in this system to (1) increase the number of free end fibers and (2) entangle the free end fibers firmly around a core portion of the bundle with a larger twisting angle. It is, however, very difficult to carry out the two operations by means of only one air nozzle. That is, in order to increase the number of free end fibers, the twist to be imparted to the fiber bundle must be suppressed so that it does not ascend and reach the vicinity of a nipping point of the feed roller. When, however, a large number of twists is imparted to the fiber bundle so that the free end fibers are firmly entangled around the core portion, the twist cannot be suppressed and tends to ascend until it reaches the vicinity of the nipping point of the feed roller.

To solve this problem, an apparatus is proposed in Japanese Examined Utility Model Publication (kokoku) No. 55-20773, in which as illustrated in FIG. 20, a first air nozzle 32 and a second air nozzle 33, each having a reverse directional twisting function are linearly arranged downstream of a front roller 31 of a drafting means and the first air nozzle 32 is provided at the exit end with a detwisting tube 34. The first air nozzle 32 causes a yarn Y to balloon, by which the yarn Y is placed in forcible contact with the detwisting tube 34. This contact suppresses the twist ascent from the second air nozzle 33 so that it does not reach the vicinity of the nipping point of the front roller 31. The prior art apparatus has a drawback in that, due to the liner arrangement of the two nozzles, the exhaust air from the first air nozzle 32 impinges on the opposing surface of the second air nozzle 33 and causes turbulence, which results in an unstable travel of the yarn Y and disturbance of the function of the second air nozzle 33.

Another prior art apparatus is disclosed in Japanese Examined Patent Publication (kokoku) No. 57-55809, in which as illustrated in FIG. 21, two air nozzles 32, 33, each having a reverse directional twisting function are arranged at an angle, so that the yarn travels through a bend. Although this apparatus solves the above problem of unstable yarn travel caused by the exhaust air from the first air nozzle 32, another drawback is generated. Namely, since the axes of the yarn passages of the two air nozzles 32, 33 intersect at an exit portion of the first nozzle 32, the yarn Y passing through the first air nozzle 32 during the threading operation at the start-up stage travels linearly along the axis of the first air nozzle 32 and thus is difficult to introduce into the second air nozzle 33, which causes problems during start-up. Further, since the yarn passage bends in the vicinity of the exit portion of the first air nozzle 32, the vortex in the first air nozzle is disturbed in this area, and thus the yarn Y is placed in forcible contact with one side of the inner wall; which, in turn, prevents the yarn from obtaining the effect of the vortex within the first air nozzle 32, i.e., the function of the first air nozzle 32 is weakened. Additionally, according to this apparatus, it is difficult to insert a seed yarn, which must be reversely inserted from the exit end of the second air nozzle 33, through the yarn passage of the first air nozzle 32 to the inlet portion of the first air nozzle 32 when yarn piecing.

An apparatus having two air nozzles arranged linearly is disclosed in Japanese Examined Patent Publication (kokoku) No. 56-52133, in which as illustrated in FIG. 22, tow air nozzles 32 and 33 are connected by a connector 35 having a space 35*a* sectioned by two planes each perpendicular to an axis of a yarn passage, for improving the threading operation from the first air nozzle side to the second air nozzle side at the start up stage. Also, according to this apparatus, since an air stream blown into the second air nozzle 33 from the exit end thereof for reversely inserting a seed yarn is rapidly dispersed, the insertion of the seed yarn is still difficult and, further, fly and foreign matter in the fiber bundle tend to be deposited around the exit end of the first air nozzle 32 and are apt to be irregularly spun into the fiber bundle to form a slub portion in the resultant yarn.

SUMMARY OF THE INVENTION

It is a primary object of the present invention to eliminate the above-mentioned drawbacks of the prior art apparatus using two air nozzles, such as unstable yarn travel and deterioration of the function of the second air nozzle due to the exhaust air from the first air nozzle where the two air nozzles are in linear arrangement, or deterioration of the function of the first air nozzle and difficulity of yarn threading due to the deflection of the yarn though contact with the first air nozzle wall, or the problem of reverse insertion of the seed yarn when yarn piecing.

The above object of the present invention is achieved by an apparatus for producing a fasciated yarn from a fiber bundle, comprising first and second air nozzles in accordance with embodiments of the present invention, wherein the first air nozzle has a first yarn passage comprising an inlet portion, a narrow channel and a wide channel, each arranged, in series, from upstream to downstream in the yarn travelling direction. The wide channel is provided in the inner wall thereof with at least a jet for ejecting air to generate a first vortex in the wide channel. The second air nozzle has a second yarn passage comprising an inlet portion, a narrow channel, an orifice, and a wide channel, each arranged in series from upstream to downstream of the yarn travel direction. The inner wall of the wide channel is provided with at least a jet for ejecting air to generate a second vortex whirling in direction counter to that of the first vortex in the wide channel of the first air nozzle. The apparatus is characterized in that a space is formed between a downstream end surface of the first air nozzle and an upstream end surface of the second air nozzle confronting the first air nozzle by connecting the two nozzles at an angle such that the yarn travels through a bend formed between the two air nozzles, and the central axes of the first and second air nozzle intersect in the inlet portion of the second air nozzle. A segment of an imaginary line intercepted between a center of an exit end of the narrow channel of the first air nozzle and a center of an entrance end of the orifice of the second air nozzle pass through the wide channel of the first air nozzle without positively touching the inner wall thereof, and a segment of a central axis of the first air nozzle intercepted between the confronting end surfaces of the first and second air nozzles has a length longer than a diameter of the exit end of the wide channel of the first air nozzle.

The space formed by the confronting surfaces of the two air nozzles is, preferably, wedge shaped, more preferably, a truncated wedge.

According to the present invention, since a fiber bundle travels through the second air nozzle while being placed in forcible contact with one side wall of the inlet portion of the second air nozzle after passing through the first air nozzle, the ascent of the twist imparted to the fiber bundle by the second air nozzle toward the upstream region is suppressed at the contact area. Moreover, the fiber bundle can pass through the first air nozzle along the area in the vicinity of the central axis thereof where disturbance of the vortex is less, and thus the twisting action of the first air nozzle on the fiber bundle is effectively carried out. In the first air nozzle, the first vortex acts on the fiber bundle in such a manner that the twist of the fiber bundle imparted by the second air nozzle is untwisted. This facilitates a decrease of the number of twists of a core portion of the fiber bundle, which in turn, increases the number of a free end fibers around the core portion and rotates the free end fibers in the direction reverse to that of the core portion, so that these fibers are entangled around the core portion at a twist angle that is the reverse of that of the core portion. This reverse directional entaglement of the free end fibers with the core portion enhances the formation of a strong yarn structure after the fiber bundle has passed through the second air nozzle. Due to the wedge shape of the space between the nozzles, the air exhausted from the exit end of the first air nozzle is smoothly dispersed therein and does not exert an adverse influence upon the yarn travel and the function of the second air nozzle. In the case of the truncated wedge shaped space, the above effect is further enhanced and the depositing of fly or other foreign matter in the space can be avoided. Finally, the reverse insertion of the speed yarn from the exit end of the second air nozzle to that of the first air nozzle during yarn piecing also can be smoothly carried out.

BRIEF DESCRIPTION OF THE DRAWINGS

Further objects and advantages of the present invention will be more apparent from the following description with reference to the accompanying drawings illustrating the preferred embodiments of the present invention, wherein.

DESCRIPTION OF THE PREFERRED EMBODIMENTS

Figure 1:
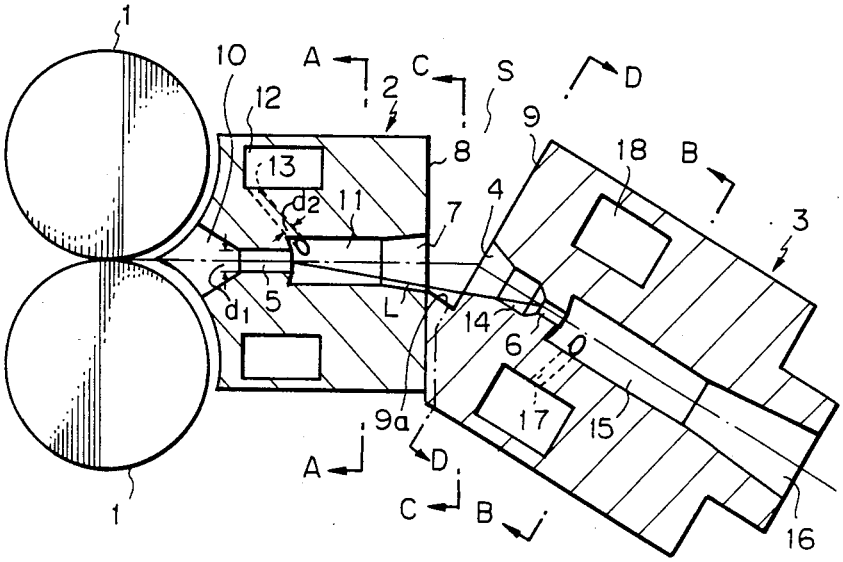
FIG. 1 is a side sectional view of a first embodiment of a apparatus using two air nozzles, according to the present invention.

In FIG. 1 when seen in the direction of travel of a fiber bundle, a first air nozzle 2 is disposed downstream of front rollers 1 which are the final rollers of a drafting means (not shown) for attenuating the fiber bundle into a ribbon shaped flat continuous body. A second air nozzle 3 is arranged downstream of the first air nozzle 2 and is connected to the first air nozzle 2 at an angle and in such a manner that a space S is formed between a downstream end surface 8 of the first air nozzle 2 and an upstream end surface 9 of the second air nozzle 3, and an imaginary line L drawn between the center of an exit end of a narrow channel 5 in the first air nozzle 2 and the center of an entrance end of a small diameter orifice 6 in the second air nozzle 3 passes through an exit portion 7 of the first air nozzle 2 without positively touching an inner wall of the exit portion 7.

Figure 5:
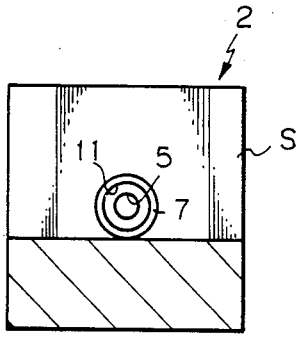
FIG. 5 is a view similar to FIG. 2 taken along line C—C of FIG. 1, and illustrating a section of a space S.
Figure 6:
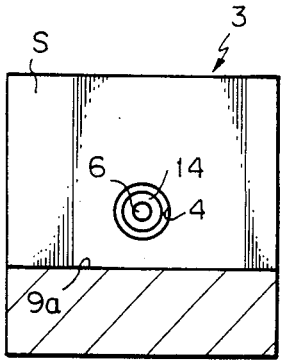
FIG. 6 is a view similar to FIG. 5 taken along line D—D of FIG. 1.
Figure 7:
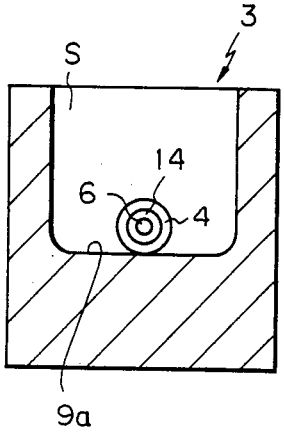
FIG. 7 is a view similar of FIG. 6 and illustrating a section of the space S of a third embodiment according to the present invention.

Confronting end surfaces 8 and 9 of the two air nozzles 2 and 3 perpendicularly intersect, respectively, the axes of the air nozzles 2 and 3, and the space S has a sectional configuration, in the plane perpendicular to the axis of the front roller 1, having a wedge shape. Preferably, the space S has a truncated wedge shape, the truncated top 9*a* of which is in line with a part of the periphery of the exit portion 7 of the first air nozzle 2, perpendicular to the above plane and parallel to the axis of the second air nozzle 3. The space S is formed, as shown in FIGS. 5 and 6, in such a manner that both sides thereof are open. The space S, however, may be formed, as shown in FIG. 7 having a shape so that the truncated top 9*a* thereof is symmetrical in relation to a plane including the axes of the two air nozzles 2 and 3, and the side walls of the space S encircle a yarn passage.

Figure 8:
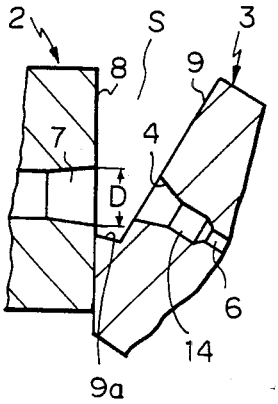
FIG. 8 is a view similar to FIG. 7, and illustrating a section of the space S of a fourth embodiment according to the present invention.
Figure 9:
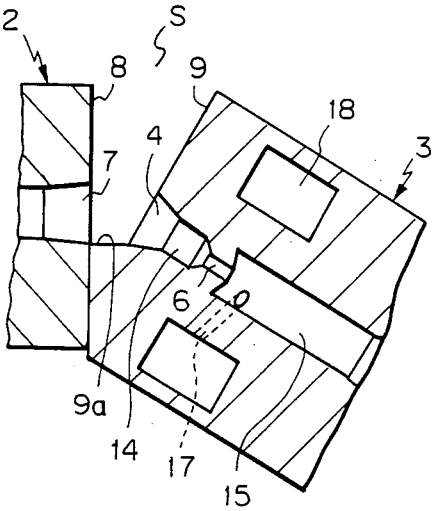
FIG. 9 is a view similar to FIG. 8 and, illustrating a section of a space S of a fifth embodiment according to the present invention.

In addition to the U-shape, the sectional configuration of the space S may be a C-shape or an arcuate shape. According to the above restrained figured space, fly and foreign matter discharged from the first air nozzle 2 together with the exhausted air tends to be guided in one direction and is easily removed by suction. It is not necessary that the truncated top wall 9*a* be in line with the periphery of the exit portion 7 of the first air nozzle 2 since, as illustrated in FIG. 8, a gap of within one half of a diameter D of the exit portion 7 is allowable. Further, in order to facilitate the insertion of a seed yarn into the exit portion of the first air nozzle 2, which yarn is transported, together with an air stream, from the exit end of the second air nozzle 3 during yarn piecing, the truncated top wall 9*a* preferably bridges the gap between the peripheries of the exit portion 7 of the first air nozzle 2 and of the inlet portion 4 of the second air nozzle 3 in a continuous manner, as shown in FIG. 9. This function is preferable because the air stream for transporting the seed yarn contains no whirling component, and thus tends to advance linearly along the truncated top wall 9*a* after being exhausted from the second air nozzle 3 into the exit portion 7 of the first air nozzle 2.

A distance between the two opposing end surfaces 8 and 9 is decided in such a manner that a segment of the extension of the central axis of the first air nozzle 2 between the opposing end surfaces 8 and 9 is larger than the diameter D of the exit end of the exit portion 7. In this connection, it is not always necessary that the opposing end surfaces 8 and 9 be perpendicular to the corresponding central axes of the air nozzles 2 and 3, respectively. Namely, some modification is allowable, provided that the distance between both opposing end surfaces 8 and 9 increases in a direction outward from the space S.

Figure 4:
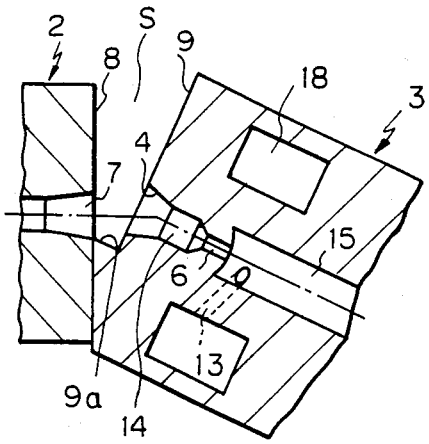
FIG. 4 is a partial side sectional view of a second embodiment according to the present invention, which embodiment has a different angle of bend from that of the first embodiment.

It is important that, in the angular arrangement of the air nozzles 2 and 3, the extension of the central axis of the first air nozzle 2 intersects the entrance end of the inlet portion 4 of the second air nozzle 3. Preferably, the axis of the first air nozzle 2 will meet the axis of the second air nozzle 3 on a plane including the end surface 9 of the second air nozzle 3 as shown in FIG. 1. The intersecting point, however, may be within the inlet portion 4 of the second air nozzle 3 as illustrated in FIG. 4. In the latter case, suction of the second air nozzle 3 on the fiber bundle to be treated is enhanced during the spinning operation and the contact of the fiber bundle with the inner wall of the inlet portion 4 is strengthened, resulting in a stable yarn quality. In addition to the above, the intersecting point may be outside of the inlet portion 4 of the second air nozzle 3, provided the extension of the central axis of the first air nozzle 2 passes the entrance end of the inlet portion of the second air nozzle 3 at any place.

Figure 2:
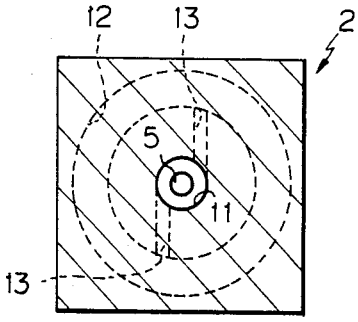
FIG. 2 is a section view of the apparatus of FIG. 1 taken along line A—A of FIG. 1.
Figure 3:
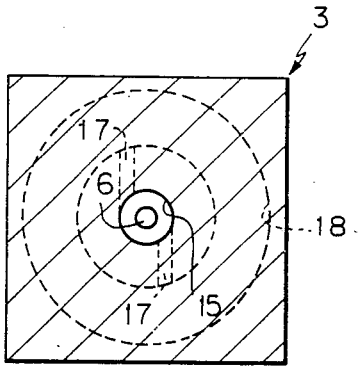
FIG. 3 is a view similar to FIG. 2 taken along line B—B of FIG. 1.
Figure 10:
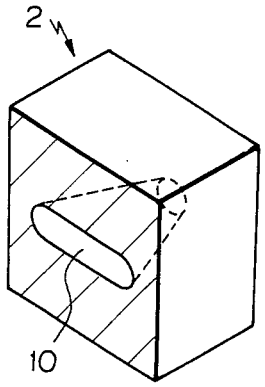
FIG. 10 is a perspective view of an inlet portion of a first air nozzle.

As shown in FIG. 1, the first air nozzle 2 has a first yarn passage therein, comprising an inlet portion 10 in the form of a truncated cone, a narrow channel 5, a wide channel 11, and an exit portion 7, each element being arranged in series from upstream to downstream along the direction of yarn travel. In the upstream region of the wide channel 11, i.e., in the vicinity of a border between the wide and narrow channels 5 and 11, a pair of jets 13 is provided, each jet 13 communicating at one end with an air tank 12 built into a shall of the nozzle body 2, the air tank 12, in turn, being connected to a pressurized air source (not shown), and opening at the other end into the inside of the wide channel 11. The opening of the jet 13 deviates from the axis of the yarn passage as illustrated in FIG. 2 so as to generate a vortex within the wide channel 11, and is inclined in a downstream direction so as to facilitate the yarn travel, as illustrated in FIG. 1. Although the exit portion 7 is shown as diverging in a downstream direction in this embodiment, it may be of the same diameter as that of the wide channel 11. In order to enhance the yarn rotating effect of the first air nozzle 2, the inner walls of the wide channel 11 and the exit portion 7 must be as smooth as possible to ensure a non-frictional surface. Although an end surface of the first air nozzle 2 confronting the front roller 1 is preferably of an arcuate shape complementary to the surface of the front roller 1, as shown in FIG. 1, it is not limited to this shape but may have any proper shape for guiding a ribbon fiber bundle supplied form the front roller 1 to the yarn passage of the first air nozzle 2, such as a wedge or a cylinder along the axis of the front roller 1. The inlet portion 10 is shaped like a truncated cone which diverges from the he narrow channel 5 to the front roller 1. The largest width of the inlet portion 10 in the vicinity of the front roller 1 depends on the count of yarn to be spun, but a range of from 6 mm to 12 mm is preferable. Alternatively, as shown in FIG. 10, the inlet portion 10 may have a flat fan shape having an identical height over the whole length thereof.

The narrow channel 5 has a constant diameter in a range of from one third to two thirds that of the wide channel 11. The function of the narrow channel 5 is to maintain the rotating action of an annular vortex generated by air ejected from the jet 13 into the inside of the wide channel 11 without being subjected to disturbance from a suction stream flowing from the inlet portion 10, thereby effectively twisting the fiber bundle, as well as to introduce the suction stream into a central area of the annular vortex through the narrow channel 5, thereby increasing the suction effect of the suction stream. Thus a diameter d 1 of the narrow channel 5 is preferably nearly equal to a value defined by the equation $d\ 1 = D - 2 \times d\ 2$, wherein D is a diameter of the wide channel 11 of the first air nozzle 2 and d 2 is a diameter of the jet 13 of the wide channel 11. For the above reason, the diameter of the narrow channel 5 is not necessarily a constant value d 1 throughout the entire length thereof but may be varied to have a larger diameter in the upstream region, provided the exit area of the narrow channel 5, i.e., in the vicinity of the wide channel 11, has a defined diameter d 1. Since the above-mentioned annular vortex is more disturbed and more of the rotating energy is lost by dispersion of the suction stream from the narrow channel 5 when the position of the opening of the jet 13 is far from the exit end of the narrow channel 5, the exit end of the narrow channel 5 should be as close as possible to the position of the opening of the jet 13. In order to attain this preferable positional relationship between the narrow channel 5 and the jet 13, the end of the narrow channel 5 may protrude inside the wide channel 11. The outer wall of the protruding end of the narrow channel 5 shall have a converging taper of more than 60° facing toward the wide channel 11 and relative to the axis of the yarn passage. In this case, if the taper angle of the outer wall of the protruding end of the narrow channel 5 is smaller than 60° relative to the axis of the yarn passage, the periphery of the exit end of the narrow channel 5 becomes very sharp and tends to become easily worn due to friction of the fiber bundle on the inner wall of the narrow channel 5.

Figure 11:
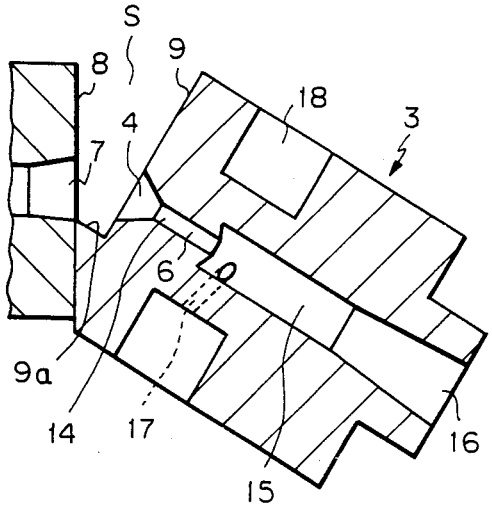
FIG. 11 is a view similar to FIG. 8, and illustrating a sixth embodiment according to the present invention, in which embodiment an orifice of a second air nozzle is omitted or merged into a narrow channel.
Figure 12:
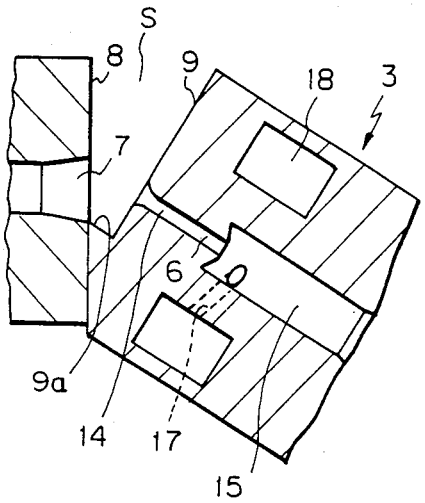
FIG. 12 is a view similar to FIG. 11 and illustrating a seventh embodiment according to the present invention, which embodiment is a modification of the sixth embodiment shown in FIG. 11.

Now an explanation will be given for the second air nozzle 3. The yarn passage of the second air nozzle 3 comprises an inlet portion 4, a narrow channel 14, an orifice 6. A wide channel 15, and an exit portion 16. A plurality of jets 17, for example, two in the illustrated embodiment shown in FIG. 1, are provided in the wide channel 15 and open at one end in the upstream region thereof in a deviated manner relative to the axis of the wide channel 15 so as to generate a vortex in the wide channel 15. Note, the direction of the vortex in the wide channel 15 is the reverse of that of the vortex in the wide channel 11 of the first air nozzle 2. The jet 17 is also inclined to enhance the forward travel of the fiber bundle in the second air nozzle 3 and communicates at the other end to an air tank 18 provided in the outer shell of the second air nozzle 3. The tank 18 is connected to a pressurized air source (not shown) as in the case of the first air nozzle 2. Accordingly, the explanation of the elements of the second air nozzle 3 that are common to those of the first air nozzle 2 is omitted and only the differing features of the second air nozzle 3 will be described. The inlet portion 4 of the second air nozzle 3 is formed in the shape of a truncated cone diverging slightly upstream. The taper angle of the inlet portion 4 is smaller than that of the inlet portion 10 of the first air nozzle 2 because, in the case of the second air nozzle 3, the inlet portion 4 receives the yarn-like fiber bundle twisted by the first air nozzle 2, and conversely, in the case of the first air nozzle 2, the inlet portion 10 must accommodate the yet untwisted flat ribbon-shaped fiber bundle, and therefore, if the inlet portion 4 is too large in width, the exhaust air from the first air nozzle 2 tends to invade the yarn passage of the second air nozzle 3 therethrough and to disturb the function of the second air nozzle 3. Thus the inlet portion 4 may be united with the narrow channel 14 so that it is either the same diameter as the latter or somewhat larger compared thereto, and the periphery of the entrance end of the inlet portion 4 may be arcuately chamfered. In this case, the area having the chamfered wall corresponds to the so-called inlet portion 4. The orifice 6 has the smallest diameter among the areas of the second air nozzle 3, as shown in FIG. 1. It may, however, be united with the narrow channel 14 as illustrated in FIG. 11, having a diameter identical to the latter and connected to the inlet portion 4 steeply converging in the downstream direction or, as illustrated in FIG. 12, the three areas 6, 14, and 4 may be united and have the same diameter, except that the entrance end of the inlet portion 4 has an arcuate chamfer. In the above case, the seed yarn sucked from an exit portion 16 of the second air nozzle 3 along with a suction stream is stably introduced to the exit portion 7 of the first air nozzle 2 during yarn piecing.

Figure 13:
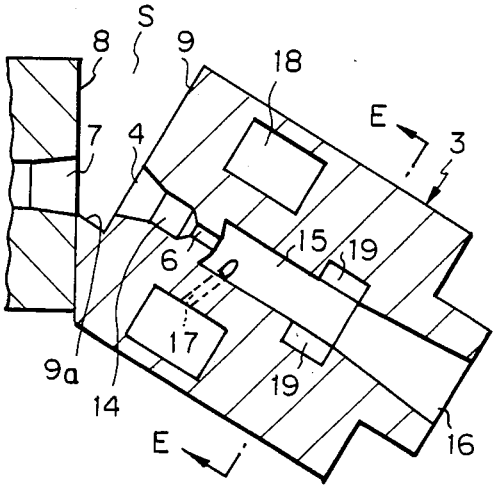
FIG. 13 is a partial side sectional view of an eighth embodiment according to the present invention, and illustrating means for enhancing the detwisting action of a second air nozzle.
Figure 14:
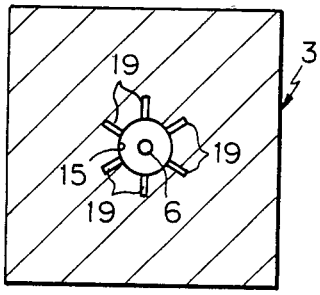
FIG. 14 s a sectional view taken along line E—E of FIG. 13.

The provision of a rough surface in the inner wall of the yarn passage will increase the frictional resistance of the wall to the fiber bundle and thus enhance the fixing of the entanglement of the free end fibers around the core portion of the fiber bundle, since the rotation of the fiber bundle is thereby forcibly prevented, and accordingly, the fiber bundle is subjected to abrupt untwisting. This rough surface may be formed by, for example, a plurality of small projections provided in a certain area of the inner wall of the yarn passage, or by a plurality of slots 19 arranged spirally or parallel to the axis of the yarn passage, as shown in FIGS. 13 and 14. The exit portion 16 preferably diverges in a downstream direction to ensure a smooth exhausting of the air ejected from the jet 17. Where the exit portion 16 has the above means for enhancing the discharge of the exhaust air, the jet 17 need not incline in a forward direction, as stated previously, but may be substantially perpendicular to the axis of the yarn passage.

According to the thus-constructed apparatus of the present invention, the flat ribbon-shaped fiber bundle continuously fed from the front rollers 1 of the drafting means is twisted and untwisted in the yarn passage by the action of the two vortices whirling in reverse directions to form a fasciated yarn while passing through the air nozzles 2 and 3. Since the fiber bundle travels through the yarn passage and is placed in forcible contact with the wall of the inlet portion 4 of the second air nozzle 3 at an angle, the twist imparted to the fiber bundle in the region of the second air nozzle 3 is prevented from ascending into the first air nozzle 2. Moreover, the vortex generated in the first air nozzle 2 acts on the fiber bundle in such a manner that it untwists the twist to the fiber bundle imparted by the vortex of the second air nozzle 3 whereby the number of twists in the core portion of the fiber bundle are decreased and the number of free end fibers, one end of which is restrained by the core portion and the other end is free, increases. The vortex in the first air nozzle 2 rotates the free end fibers in the direction that is the reverse of that of the rotation of the core portion, which causes the free end fibers to be entangled around the core portion at an angle of twist that is the reverse of that of the core portion. Since this entangling direction of the free end fiber matches that of the surface fiber of the resultant fasciated yarn, the entangling effect of the yarn is extraordinarily enhanced. Also, since the line L between the narrowest areas of both the air nozzles 2 and 3 passes within the exit portion 7 without touching the inner wall thereof, and the fiber bundle is always in contact with the inner wall of the inlet portion 4 of the second air nozzle 3, the fiber bundle is not in strong contact with the inner wall of the exit portion 7 of the first air nozzle 2, and thus the fiber bundle can be smoothly twisted in the first air nozzle 2 by the vortex even if a smaller amount of air is ejected from the jet 13.

The exhaust air discharged from the first air nozzle 2 disperses in wedge shape space S and does not have an adverse influence on the function of the second air nozzle 3. In the case of the truncated wedge shaped space S as illustrated and described above, the air stream discharged from the first air nozzle 2 is immediately and uniformly dispersed throughout the space S and fly and foreign matter discharged together with the exhaust air from the first air nozzle 3 are removed outside of the space S before they can be deposited thereon. During yarn piecing, it is necessary to insert the seed yarn in reverse, i.e., from the second air nozzle 3 to the first air nozzle 2. The seed yarn is introduced form the exit portion 16 into the yarn passage along with air stream for transporting the seed yarn and is passed to the exit portion 7 of the first air nozzle 2 while the air stream is guided along the truncated wall 9*a*. On the contrary, during start-up of the spinning operation, a front end of the fiber bundle emerging from the exit portion 7 of the first air nozzle 2 can be smoothly introduced into the inlet portion 4 of the second air nozzle 3 because the central axis of the first air nozzle 2 intersects the entrance end of the inlet portion 4 of the second air nozzle 3.

Figure 15:
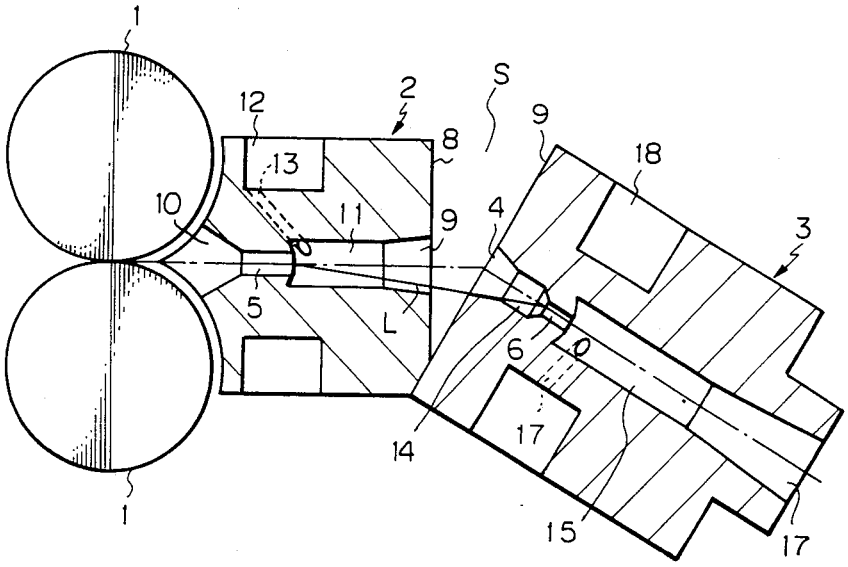
FIGS. 15 to 19 illustrate further embodiments according to the present invention, which embodiment having a space S having a non-truncated shape. Here, FIG. 15 corresponds to FIG. 1, FIG. 16 to FIG. 11, FIG. 17 to FIG. 13, and FIGS. 18 and 19 to FIG. 14.
Figure 16:
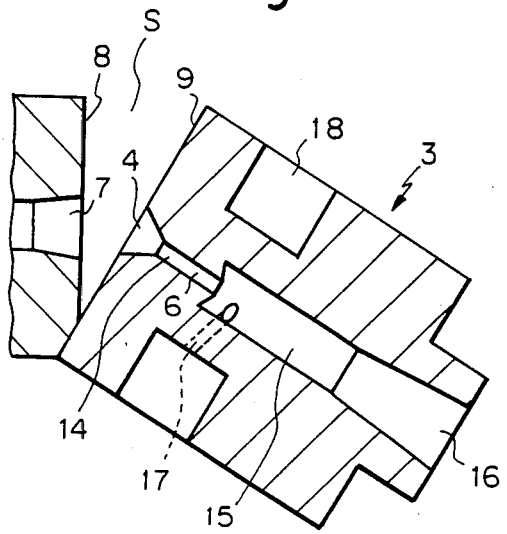
Figure 17:
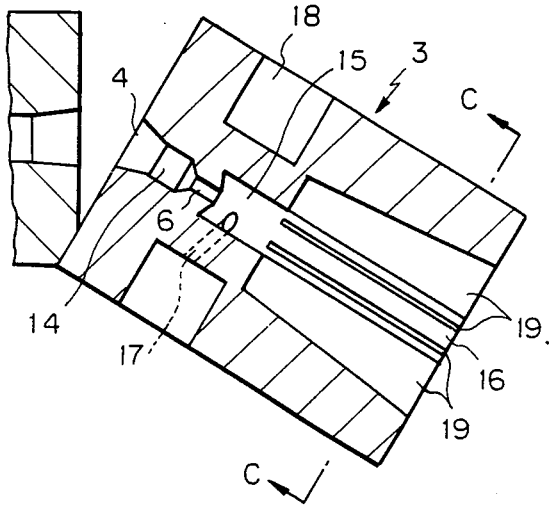

The shape of the space S is not limited to the truncated wedge shape as described and illustrated above, but may be a simple wedge shape as shown in FIGS. 15, 16, and 17, corresponding to FIGS. 1, 11, and 13, respectively, although the yarn guiding function of the latter is somewhat inferior to that of the former during yarn piecing.

Figure 19:
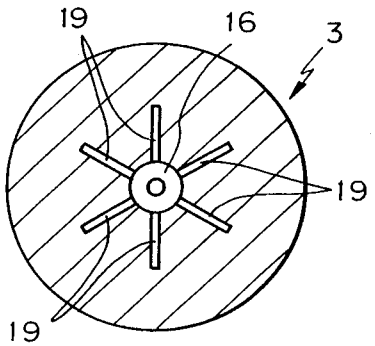
Figure 18:
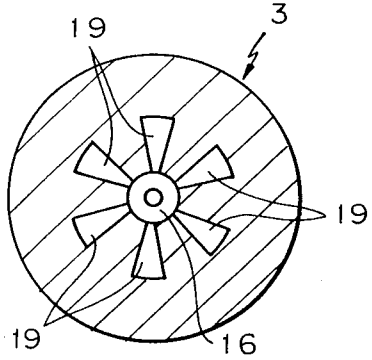
Figure 20:
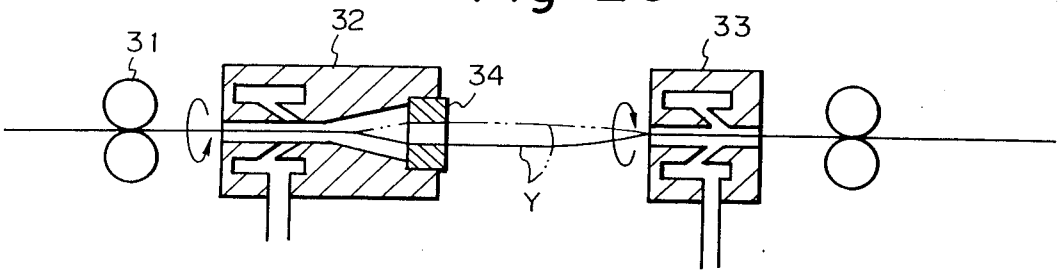
Fig. 20 PRIOR ART
FIGS. 20 to 22 are side sectional views of the apparatus using two air nozzles according to the prior art.
Figure 21:
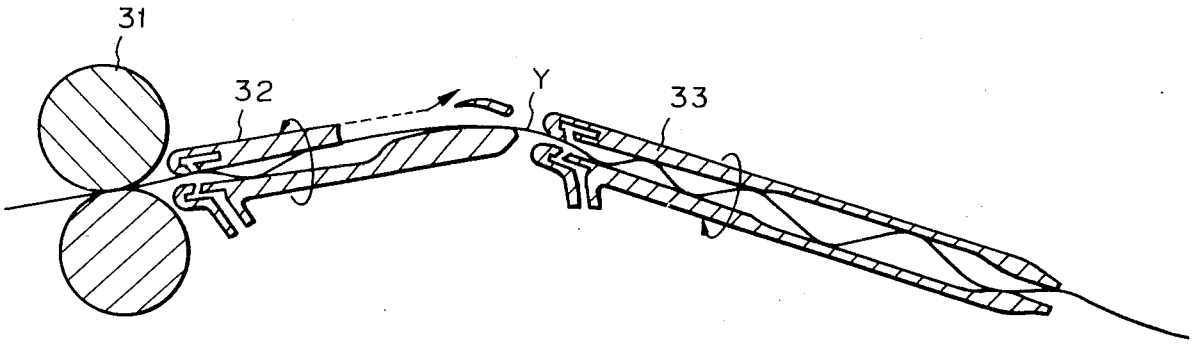
Fig. 21 PRIOR ART
Figure 22:
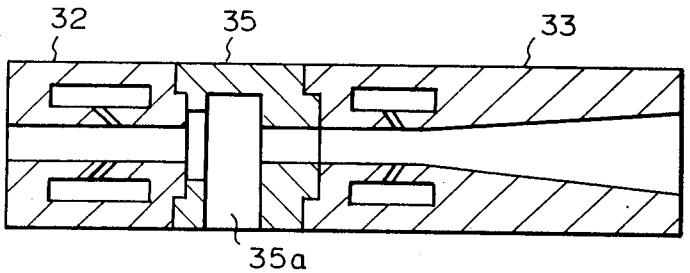
Fig. 22 PRIOR ART

Further, the means for enhancing the discharge of the exhaust air (slot 19) may be formed, as shown in FIG. 17, in such a manner that the slot 19 reaches the exit end of the exit portion 16 and communicates with the outer air. The cross section of the radially arranged slot 19 may have a width that is gradually increased toward the bottom wall thereof, as shown in FIG. 18, or may be of a constant width as shown in FIG. 19. The number of slots 19 provided depends on the width thereof, however, a larger number is preferable, such as 6 to 8, having a rather small width.

As stated above, according to the present invention, the ascent of the twist in the fiber bundle imparted by the second air nozzle is suppressed so that it does not reach the first air nozzle, which enhances the generation of the free end fibers in the fiber bundle. The angular arrangement of the two air nozzles causes the fiber bundle to pass through the first air nozzle without coming into strong contact with the inner wall thereof, whereby the fiber bundle can be effectively twisted by the least amount of air ejected from the jet, and thus a strongly entangled fasciated yarn is obtained. Because of the provision of the wedge shaped space between the two air nozzles, the deposition of foreign matter and fly in the vicinity of the exit area of the first air nozzle is prevented. According to a special embodiment of the present invention having a truncated wedge shaped space, insertion of the seed yarn and the introduction of the fiber bundle from one air nozzle into the adjacent air nozzle are easily carried out during yarn piecing or start-up of the spinning operation.

We claim:

1. An apparatus for producing a fasciated yarn from a fiber bundle, comprising a first and a second air nozzle, said first air nozzle having a first yarn passage comprising an inlet portion, a narrow channel and a wide channel, each arranged, in series, from upstream to downstream in the yarn travel direction, said wide channel being provided in the inner wall thereof with at least a jet for ejecting air to generate a first vortex in said wide channel, and said second air nozzle having a second yarn passage comprising an inlet portion, a narrow channel, an orifice and a wide channel, each arranged, in series, from upstream to downstream of the yarn travel direction, said wide channel being provided in the inner wall thereof with at least a jet for ejecting air to generate a second vortex whirling in a direction counter to that of said first vortex in said wide channel of said first air nozzle, said apparatus being characterized in that, a space is formed between a downstream end surface of said first air nozzle and an upstream end surface of said second air nozzle confronting the end surface of the first air nozzle by connecting said two nozzles at an angle, central axes of said first and second air nozzles intersect each other in said inlet portion of said second air nozzle, a segment of a imaginary line between a center of an exit end of said narrow channel of said first air nozzle and a center of an entrance end of said orifice of said second air nozzle passes through said wide channel of said first air nozzle, and a segment of a central axis of said first air nozzle between said confronting end surfaces of said first and second air nozzles has a length longer than a diameter of the exit end of said wide channel of said first air nozzle.

2. An apparatus according to claim 1, characterized in that said space is in the form of a wedge formed by said confronting end surfaces of said first and second nozzles.

3. An apparatus according to claim 2, characterized in that said wedge formed space has a truncated shape.

4. An apparatus according to claim 3, characterized in that said space is symmetrical relative to a plane including the axes of said two air nozzles.

5. An apparatus according to claim 4, characterized in that said space in the form of the truncated wedge is encircled by a U-shaped wall.

6. An apparatus according to claim 4, characterized in that said space in the form of the truncated wedge is encircled by an arcuate wall.

7. An apparatus according to claim 2, characterized in that said space is symmetrical relative to a plane including the axes of said two air nozzles.

8. An apparatus according to claim 1, characterized in that said confronting end surfaces of said first and second air nozzles perpendicularly intersects the axes of said corresponding air nozzles, respectively.

9. an apparatus according to claim 1, characterized in that the shape of said inlet portion of said first air nozzle is a truncated cone.

10. An apparatus according to claim 1, characterized in that a plurality of slots are formed in the inner wall of said wide channel of said second air nozzle along the yarn passage.

* * * * *